US008177091B2

(12) United States Patent
Kearney, II

(10) Patent No.: US 8,177,091 B2
(45) Date of Patent: May 15, 2012

(54) CONTAINER AND LATCH ASSEMBLY THEREFOR

(75) Inventor: Thomas S. Kearney, II, Summit, NJ (US)

(73) Assignee: L'Oreal, Paris (FR)

( * ) Notice: Subject to any disclaimer, the term of this patent is extended or adjusted under 35 U.S.C. 154(b) by 1028 days.

(21) Appl. No.: 11/870,170

(22) Filed: Oct. 10, 2007

(65) Prior Publication Data

US 2009/0095753 A1 Apr. 16, 2009

(51) Int. Cl.
*B65D 43/26* (2006.01)

(52) U.S. Cl. ..... 220/264; 220/263; 220/326; 132/293

(58) Field of Classification Search ..... 220/326, 220/263, 264; 132/293
See application file for complete search history.

(56) References Cited

U.S. PATENT DOCUMENTS 4,679,576 A * 7/1987 Yuhara et al. ..... 132/293
4,683,899 A * 8/1987 Yuhara et al. ..... 132/293
4,774,973 A * 10/1988 Gueret ..... 220/326
4,834,122 A * 5/1989 Yuhara et al. ..... 132/301
4,917,131 A * 4/1990 Contreras, Sr. ..... 132/301
4,930,528 A * 6/1990 Hatakeyama ..... 132/301
4,972,860 A * 11/1990 Yuhara et al. ..... 132/301
4,989,622 A * 2/1991 Kozuka et al. ..... 132/301
5,295,496 A * 3/1994 Machelett ..... 132/293
5,906,274 A * 5/1999 McEwan ..... 206/308.1
6,283,281 B1 * 9/2001 Pandolph et al. ..... 206/308.1
2005/0139598 A1 * 6/2005 Tack et al. ..... 220/259.1

* cited by examiner

*Primary Examiner* — Anthony Stashick
*Assistant Examiner* — Christopher McKinley
(74) *Attorney, Agent, or Firm* — Connolly Bove Lodge & Hutz LLP

(57) ABSTRACT

A container is disclosed. A lid is affixed to a base at a hinged connection. The base includes an enclosure, and the lid includes a catch, the catch being opposite the enclosure. A latch assembly is disposed within the enclosure and includes a button within an opening in the enclosure, a latch, and at least one spring member. The latch extends from the button into sliding relationship with an actuating member, which is configured to actuate the latch when the button is depressed. When the lid is in a closed position, the latch engages the catch. The spring member extends away from the button into sliding relationship with the base. When the button is depressed, the latch disengages the catch, and the spring member resiliently flexes as the end of the spring member slides along a portion of the base.

14 Claims, 7 Drawing Sheets

CONTAINER AND LATCH ASSEMBLY THEREFOR

BACKGROUND OF THE INVENTION

1. Field of the Invention

The field of the present invention is hinged containers and the latch assemblies associated therewith, particularly clam-shell style compact cases, such as those frequently used to hold make-up.

2. Background

Various constructions for hinged containers are known in the art. Make-up compacts in particular, especially those of the clam-shell variety, typically include a base housing a make-up tray and a lid that is hinged to the base and can be closed to cover the base when the compact is not in use. Some known make-up compacts have latch assemblies that retain the lid in a closed position and include a button or other component that can be actuated in order to release the lid to an open position. One such make-up compact is disclosed in U.S. Pat. No. 4,774,973, the disclosure of which is incorporated herein by reference in its entirety. Some of the known latch assemblies have multiple discrete components, which result in relatively high manufacturing and assembly costs and greater assembly time and difficulty. Additionally, known latch assemblies can have reliability issues due to stress and fatigue placed on parts of the latch assembly due to repeated use.

SUMMARY OF THE INVENTION

The present invention is directed towards a container and latch assembly. A lid is affixed to a base at a hinged connection, with the base including an enclosure and the lid including a catch disposed opposite the enclosure. A latch assembly is disposed within an enclosure included in the base. The latch assembly includes a button disposed within an opening in the enclosure, a latch, and at least one spring member. The latch extends from the button into sliding relationship with an actuating member, which is configured to actuate the latch when the button is depressed. When the lid is in the closed position, the latch engages the catch, such that, when actuated, the latch disengages the catch. The spring member extends from the button and is configured to resiliently flex when the button is depressed.

In a first separate aspect of the present invention, the spring member extends from the button into sliding relationship with the base. When the button is depressed, the end of the spring member slides along a portion of the base, thereby causing the spring member to resiliently flex. The spring member may comprise one or more posts extending from the button, with one or more arched legs extending from the end of each post to the base. Optionally, the end of each spring member may comprise a radially defined foot. As another option, the base may include tracks along which the ends of the spring members slide when the button is depressed.

In a second separate aspect of the present invention, the spring member includes a post extending from the button toward a bearing surface within the enclosure. The post terminates in an arcuate end which tangentially bears against the bearing surface.

In a third separate aspect of the present invention, any of the foregoing aspects may be employed in combination.

Accordingly, an improved container and latch assembly therefor are disclosed. Advantages of the improvements will appear from the drawings and the description of the preferred embodiment.

BRIEF DESCRIPTION OF THE DRAWINGS

In the drawings, wherein like reference numerals refer to similar components.

DETAILED DESCRIPTION OF THE PREFERRED EMBODIMENTS

Figure 1:
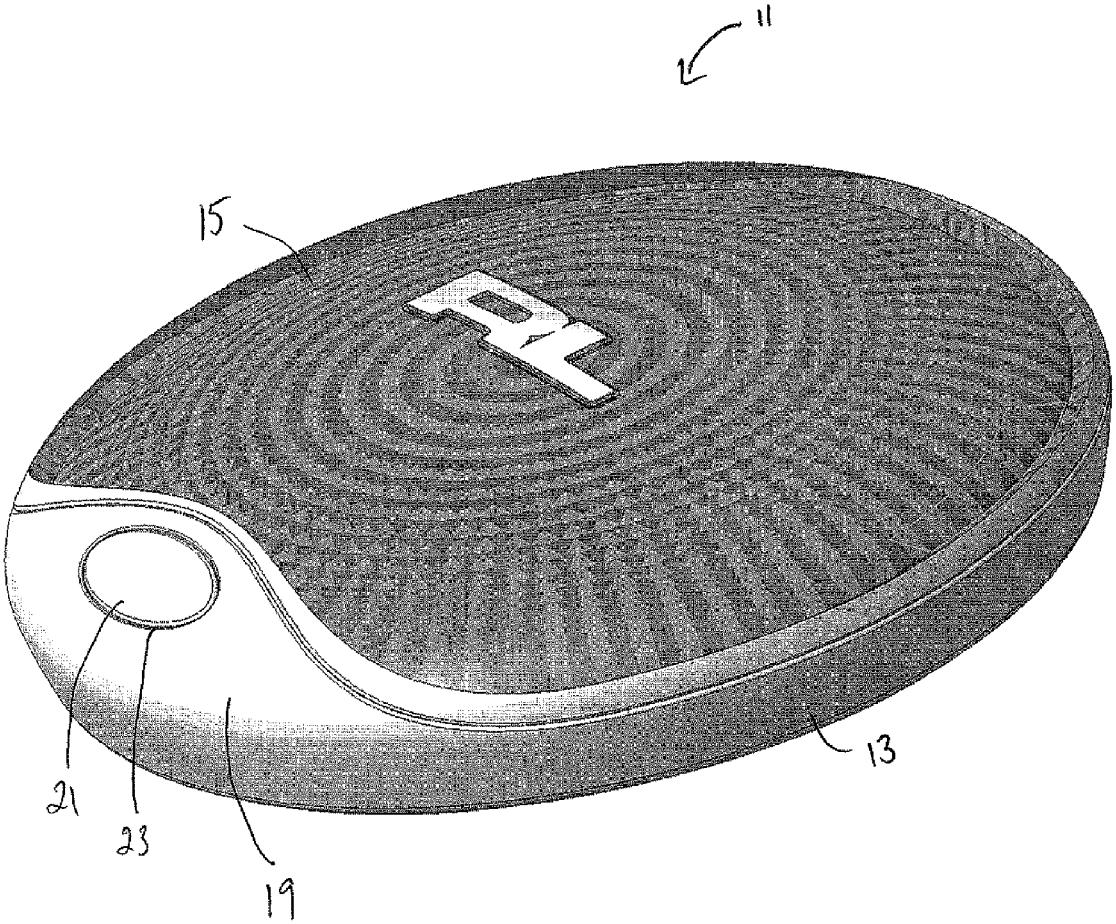
FIG. 1 is a perspective view of a hinged container in a closed configuration.
Figure 2:
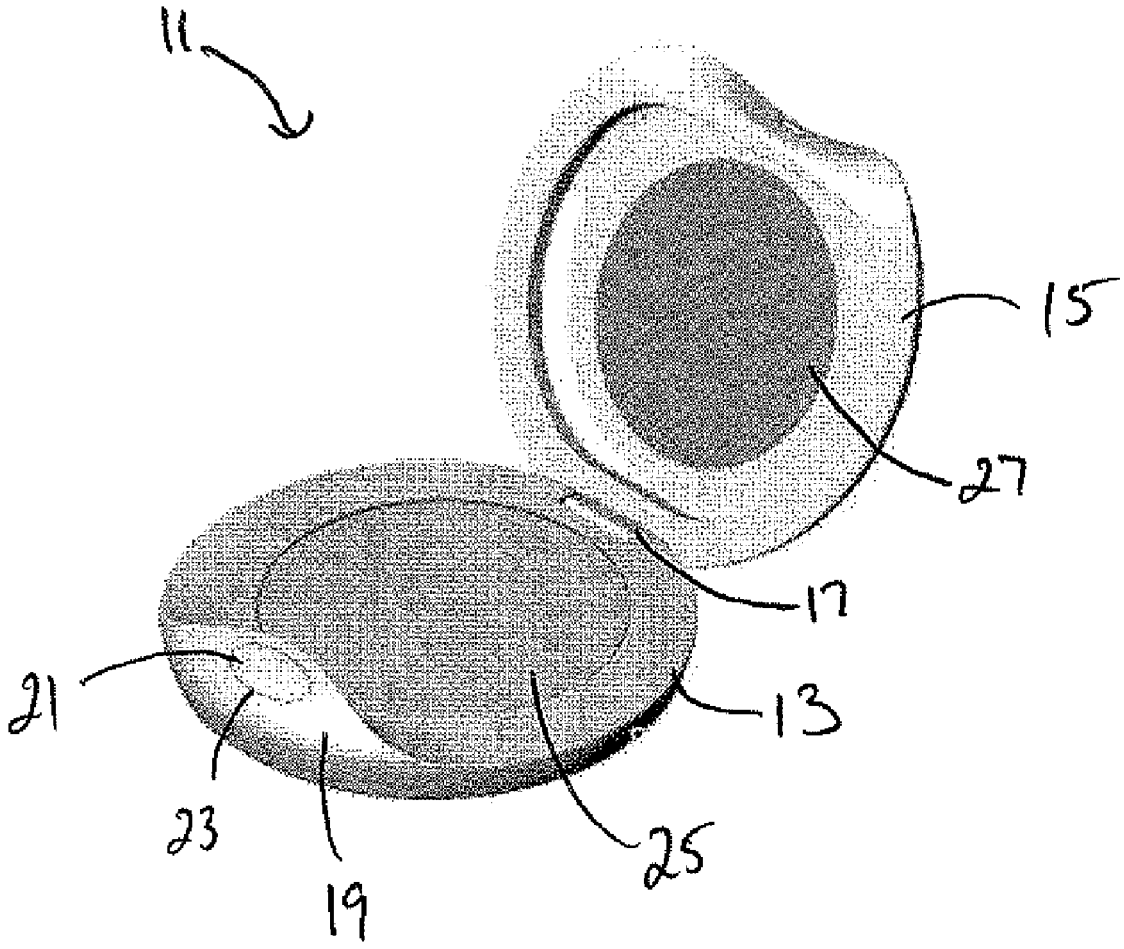
FIG. 2 is a perspective view of the hinged container of FIG. 1 in an open configuration.

Turning in detail to the drawings, FIGS. 1 & 2 illustrate a hinged container in the form of a make-up compact 11. In FIG. 1, the base 13 and lid 15 are shown in the closed position. As shown in FIG. 2, the base 13 and lid 15 are affixed at a hinged connection 17, thereby enabling them to be moved into an open position. The closed position, as that term is used herein, is defined as the relative position between the base 13 and the lid 15 where the base 13 is secured to the lid 15 by the latch assembly in the manner described below. The open position, as that term is used herein, is defined as any relative hinged position between the base 13 and lid 15 in which those two parts are not secured by the latch assembly. The hinged connection 17 is of any type commonly known and practiced in the art of make-up compacts. A front housing portion 19 of the base 13, opposite the hinged connection 17, integrally forms an enclosure in which a latch assembly is disposed, as particularly shown in FIGS. 1 & 2. As used herein, the term "integrally forms" or "integrally formed" refers to contiguous elements, i.e. elements which are not made of separate components. A button 21, which is integrated into the latch assembly, is exposed through an opening 23 in the front housing portion 19 of the base. The button 21, described in further detail below, enables the user to actuate the latch assembly to move the base 13 and lid 15 from the closed position into an open position.

The make-up compact 11 includes features that are common to many prior art make-up compacts. The base 13 and lid 15 are constructed from molded plastic materials, although any suitable materials may be used. The base 13 and the lid 15 both have generally circular, complimentary shapes, although they may be constructed to have any suitable shape desired. The base 13 is formed to have an overall shape that accommodates a make-up tray 25, and the lid 15 is formed to have a shape that accommodates a mirror 27, such that both the make-up tray 25 and mirror 27 are enclosed within the compact 11 when the base 13 and lid 15 are in the closed position. The utilization of the base 13 and the lid 15, however, may be for any desired purpose.

Figure 3:
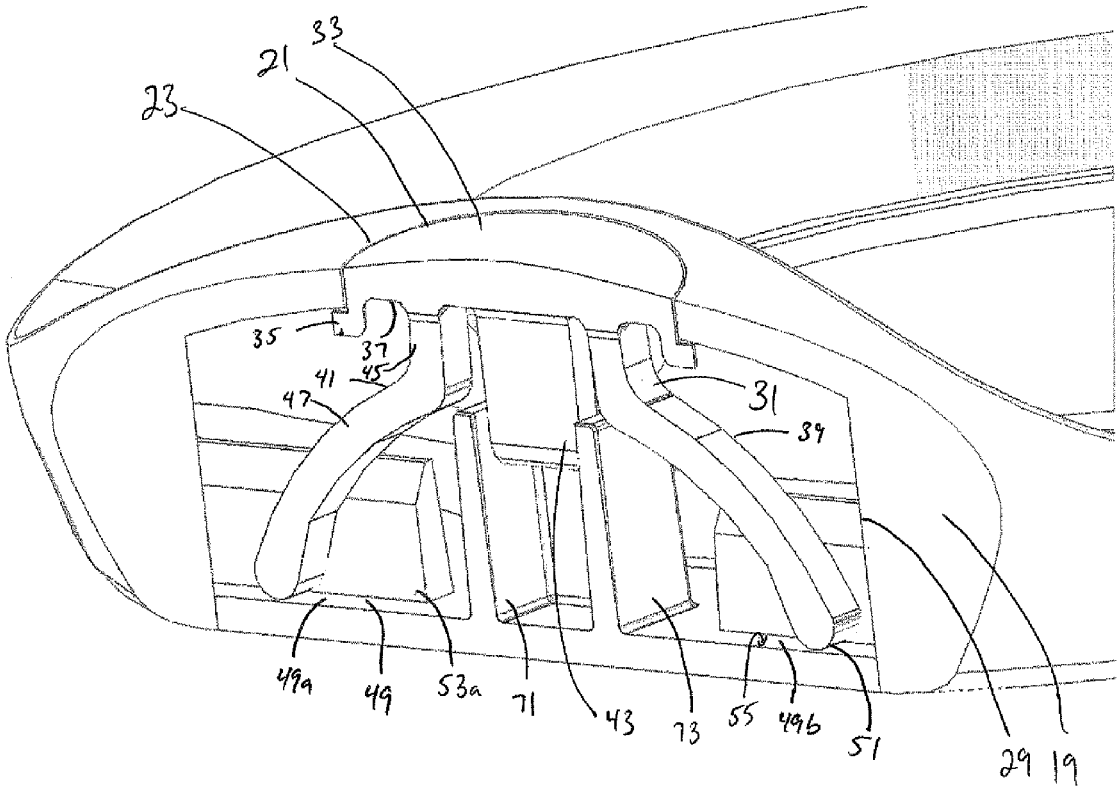
FIG. 3 is a first partial perspective cross-sectional view of the hinged container of FIG. 1 showing a first latch assembly.

FIG. 3 shows the enclosure 29 within the front housing portion 19, and the latch assembly 31 disposed therein, such that the top surface 33 of the button 21 is exposed through the opening 23 in the enclosure 29. The latch assembly 31 is preferably integrally formed, although the various parts may be manufactured separately if desired. Tabs 35 extend from the undersurface 37 of the button 21 to beyond the perimeter of the opening 23 so as to retain the button 21 within the enclosure 29. The latch assembly 31 shown has two resilient and flexible spring members 39, 41 and a latch 43, although a single spring member, or more than two, may be employed. Each spring member 39, 41 includes a post 45, extending from the undersurface 37 of the button 21, and an arched leg 47, extending from the end of each post 45 toward the track 49, which is formed non-contiguously from a first track portion 49*a* and a second track portion 49*b* within the enclosure 29. Each arched leg 47 terminates in a radially defined foot 51, with the feet 51 being placed in sliding relationship with the track 49. The feet may have any appropriate shape, or be formed of any appropriate material, that reduces friction and facilitates sliding within the tracks.

Figure 4:
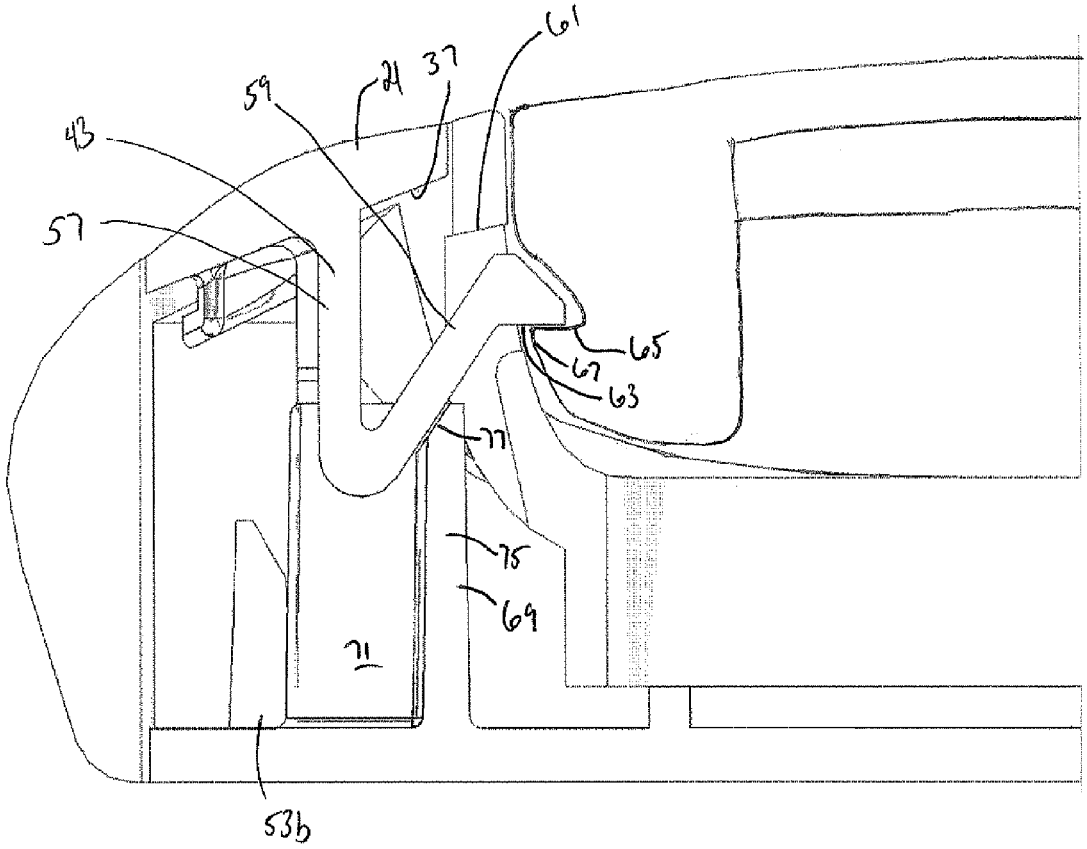
FIG. 4 is a second partial cross-sectional view of the hinged container of FIG. 1 showing the first latch assembly.

As can be seen from FIGS. 3 & 4, each track portion 49*a*, 49*b* is defined by the portion of the base 13 along which the spring members 39, 41 slide. As shown, each track portion 49*a*, 49*b* has a pair of walls 53*a*, 53*b* disposed on either side of a bearing surface 55, against which the feet 51 slide when the button 21 is pushed. The walls 53*a*, 53*b* also provide lateral support to the arched legs 47, thereby imparting additional stability to the latch assembly 31. When the button 21 is pushed, the feet 51 slide laterally within their respective track portions 49*a*, 49*b*, causing each arched leg 47 to flex—the posts 45 may also flex. By having the feet 51 slide laterally, a greater portion of the arched legs 47 can flex, thus distributing the mechanical stress resulting from repeated use over a greater portion of the legs. The resilience of the material used for the latch assembly 31, which may be any material that is appropriately resilient and flexible for this application, preferably a plastic, acts to return the entire latch assembly, including the arched legs 47, to its original configuration when the button is released.

Referring still to FIGS. 3 & 4, the latch 43 is generally V-shaped, with a first leg 57 extending from the undersurface 37 of the button 21, and the second leg 59 extending from the end of the first leg through a second opening 61 in the enclosure 29. The second leg 59 includes a latch surface 63 which is positioned to engage the catch 65 formed in the lid 15 when the base 13 and lid 15 are moved into the closed position. As the base 13 and the lid 15 are moved into the closed position, the lip 67 in the lid 15 bears against the second leg 59, causing the second leg 59 to resiliently flex away from the lip 67. The lip 67 then slides past the latch surface 63, and the second leg 59 to returns to its original configuration, causing the latch surface 63 to engage the catch 65. This action secures the base 13 to the lid 15 in the closed position. The latch 43 is disposed in sliding relationship with the actuating member 69, which is shown as a three-walled structure formed as part of the base 13. Two of the walls 71, 73 provide lateral support for the latch 43, while the third wall 75 includes a bearing surface 77, which is positioned to bear against and cause the second leg 59 to resiliently flex away from the catch 65 when the button 21 is pressed, causing the latch surface 63 to disengage from the catch 67.

The hinged connection 17 is constructed to bias the base 13 and the lid 15 away from the closed position, but not significantly. The force of the bias is preferably sufficient to wedge the base 13 and the lid 15 into an open position at an acute angle, although the amount of biasing force is completely a matter of design preference.

Figure 5:
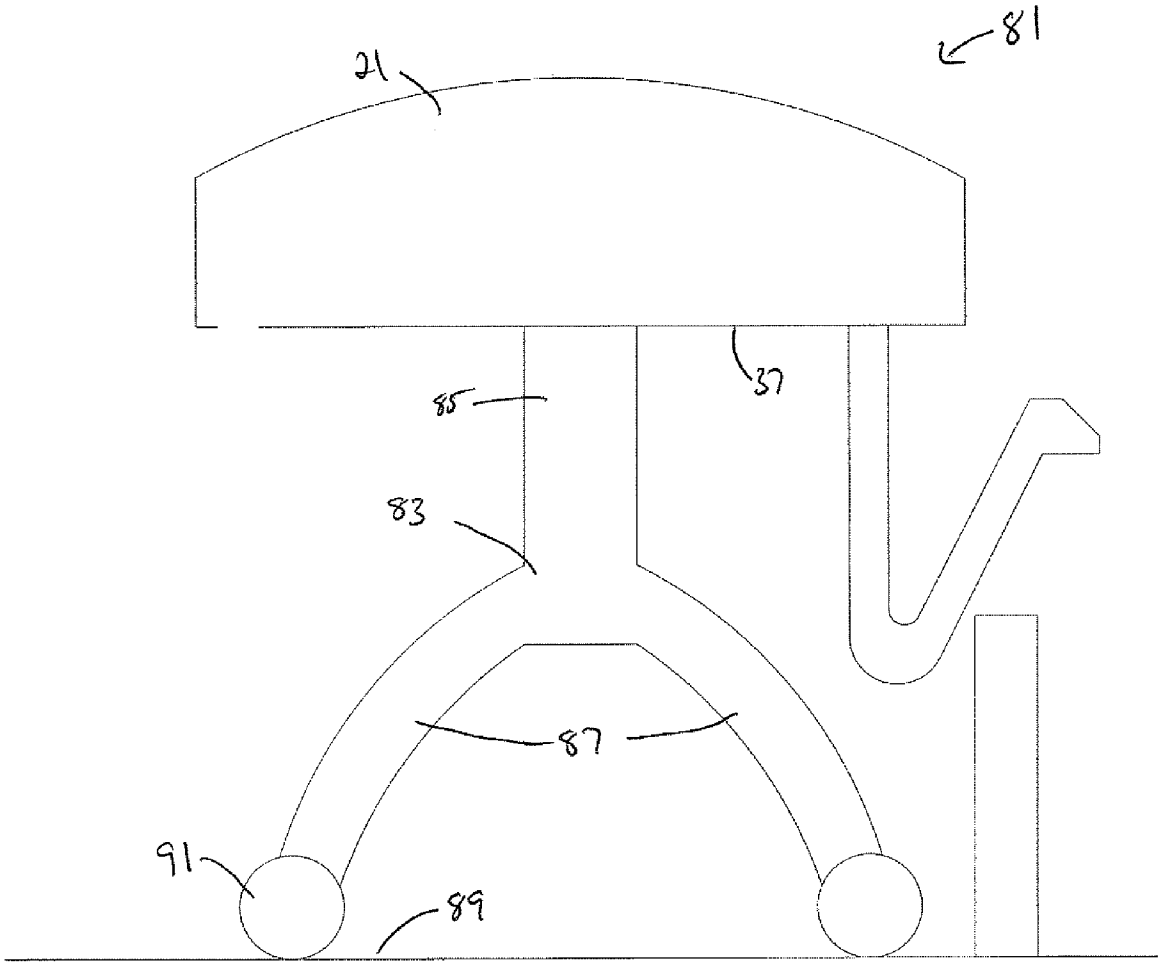
FIG. 5 is a side view of a second latch assembly.

FIG. 5 illustrates a latch assembly 81 having an alternative configuration for the spring member 83. This spring member 83 has a single post 85 extending from the undersurface 37 of the button 21 and two arched legs 87 extending from the end of the post 85 toward the track 89. The end of each arched leg 87 terminates in a radially defined foot 91. In this configuration, the legs 87 are shown sliding in a direction toward and away from the latch 43. In practice, the legs may slide in any direction desired relative to the latch.

Figure 7:
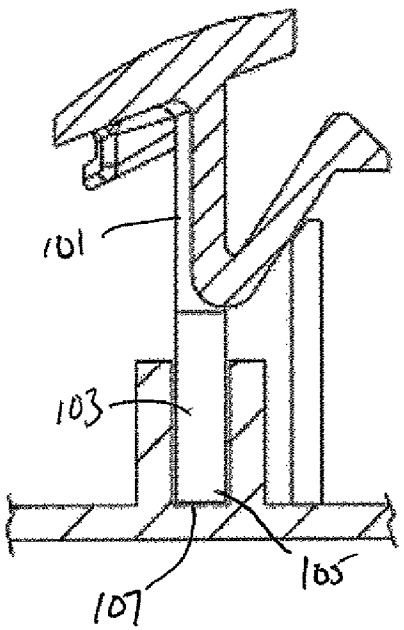
FIG. 7 is a side cross-sectional view of the third latch assembly shown positioned within the enclosure of a hinged container.
Figure 6:
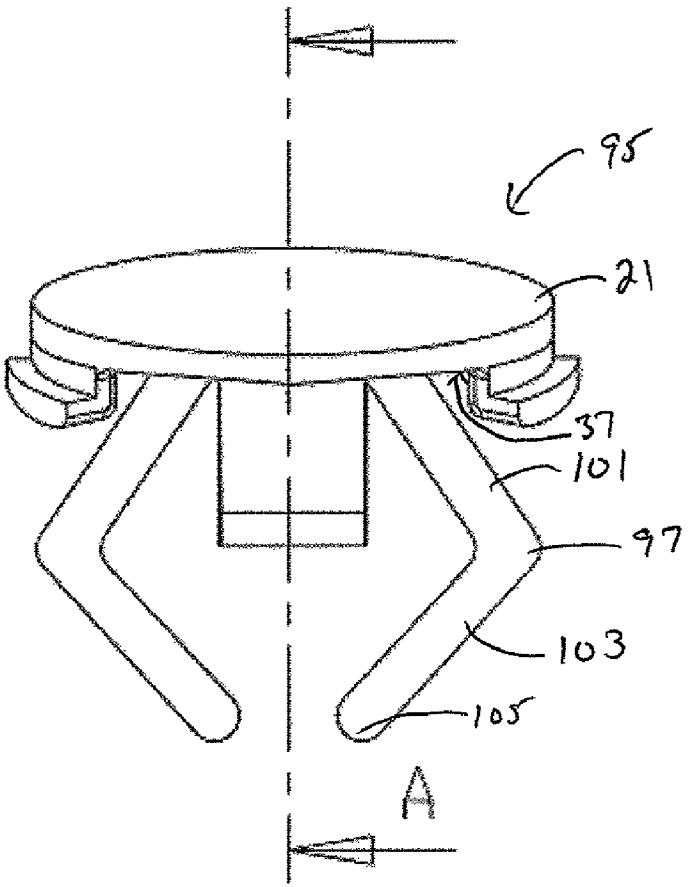
FIG. 6 is a perspective view of a third latch assembly.

A latch assembly 95 having another alternative configuration for the spring members 97 is shown in FIG. 6. The two identically formed spring members 97 extending from the undersurface 37 of the button 21. Each spring member 97 has a first leg portion 101 extending from the undersurface 37 of the button 21, and a second leg portion 103 extending from the end of the first leg portion 101 at an angle. Like the other configurations described above, the end 105 of the second leg portion 103 is radially defined. Referring also to FIG. 7, this configuration allows the end 105 of the second leg portion 103 to slide in the track 107 within the enclosure of the base so that the mechanical stress due to repeated use can be distributed across a greater portion of the spring members 97. Alternatively, the configuration of the legs may be designed to place or distribute the mechanical stress along almost any desired portion of the legs.

Figure 8:
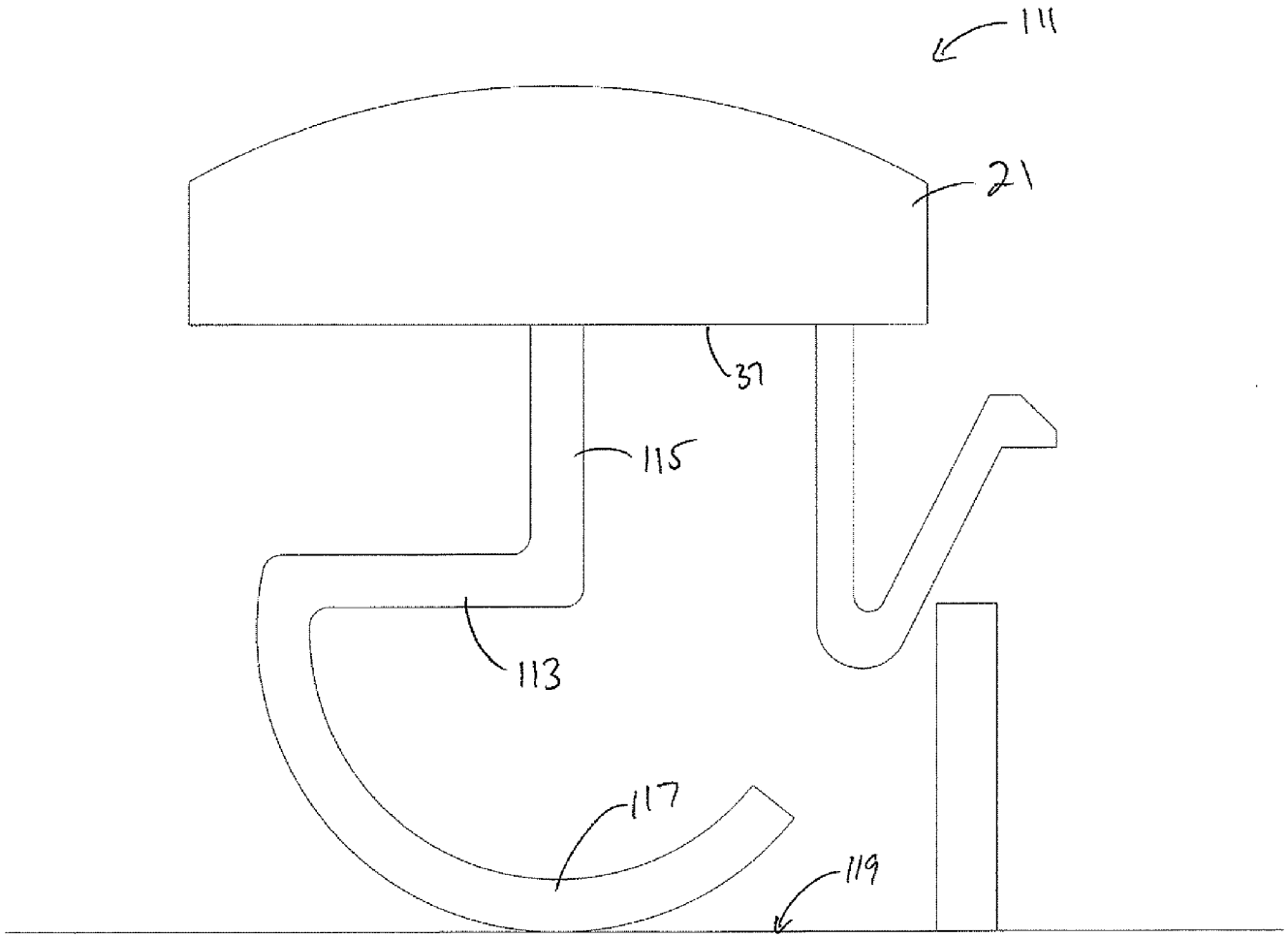
FIG. 8 is a side view of a fourth latch assembly.

FIG. 8 illustrates a latch assembly 111 having yet another alternative configuration for the spring member 113. This spring member 113 has a single post 115 extending from the undersurface 37 of the button 21, the post 115 terminating in an arcuate end 117 which tangentially bears against a bearing surface 119 within the enclosure. The arcuate end 117 is not held in a fixed position relative to the bearing surface 119. Rather, the arcuate end 117 merely rests against the bearing surface 119 and is permitted to roll along or rotate with respect to the bearing surface 119 when the button 21 is pressed. By not holding the spring member 113 in a fixed position relative to the bearing surface 119 (or the base of the compact), mechanical stresses resulting from repeated button presses can be distributed along a greater portion of the spring member 113.

Thus, a container and latch assembly are disclosed. While embodiments of this invention have been shown and described, it will be apparent to those skilled in the art that many more modifications are possible without departing from the inventive concepts herein. Particularly, while embodiments are disclosed in the context of make-up compacts, the inventive aspects described herein may be incorporated into any hinged container. The invention, therefore, is not to be restricted except in the spirit of the following claims.

What is claimed is:

1. A container comprising:

a base having a front housing portion, opposite a hinged connection, that integrally forms an enclosure with an opening;

a lid affixed to the base at a hinged connection, the lid being movable between an open position and a closed position, wherein the lid includes a catch, the catch being opposite the enclosure; and a latch assembly disposed within the integrally formed enclosure, the latch assembly including:

a button disposed within the opening, a latch extending from the button, at least one spring member extending away from the button in sliding relationship with the base, wherein when the button is depressed, an end of the at least one spring member slides along a portion of the base, thereby causing the spring member to resiliently flex, and an actuating member within the integrally formed enclosure in sliding relationship with the latch, wherein the actuating member is configured to actuate the latch when the button is depressed, and when the lid is in the closed position, the latch engages the catch, such that when actuated, the latch disengages the catch.

2. The container of claim 1, wherein an end of each spring member comprises a radially defined foot.

3. The container of claim 1, wherein each spring member comprises at least one arched leg that has an arched shape before the button is pressed.

4. The container of claim 3, wherein each arched leg extends away from a post toward the portion of the base, the post connecting the arched leg to the button.

5. The container of claim 4, wherein the latch assembly comprises one post for each arched leg.

6. The container of claim 1, each spring member comprising a first leg extending from the button, and a second leg extending at an angle from an end of the first leg toward the portion of the base, wherein an end of the second leg slides along the portion of the base.

7. A container comprising:

a base having a front housing portion, opposite a hinged connection, that integrally forms an enclosure with an opening;

a lid affixed to the base at a hinged connection, the lid being movable between an open position and a closed position, wherein the lid includes a catch, the catch being opposite the integrally formed enclosure; and a latch assembly disposed within the integrally formed enclosure, the latch assembly including:

a button disposed within the opening, a latch extending from the button, at least one spring member including an arched leg extending away from the button into sliding relationship with a track within the integrally formed enclosure, wherein an end of the arched leg is radially defined, and when the button is depressed, the radially defined end slides within the track, thereby causing the spring member to resiliently flex, and an actuating member within the integrally formed enclosure in sliding relationship with the latch, wherein the actuating member is configured to actuate the latch when the button is depressed, and when the lid is in the closed position, the latch engages the catch, such that when actuated, the latch disengages the catch.

8. The container of claim 7, wherein each arched leg extends away from a post toward the track, the post connecting the arched leg to the button.

9. The container of claim 8, wherein the latch assembly comprises one post for each arched leg.

10. A container comprising:

a base having a front housing portion, opposite a hinged connection, that integrally forms an enclosure with an opening;

a lid affixed to the base at a hinged connection, the lid being movable between an open position and a closed position, wherein the lid includes a catch, the catch being opposite the integrally formed enclosure; and a latch assembly disposed within the integrally formed enclosure, the latch assembly including:

a button disposed within the opening, a latch extending from the button, a spring member having a post extending from the button toward a bearing surface within the integrally formed enclosure, the post terminating in an arcuate end, wherein the arcuate end tangentially bears against the bearing surface, and an actuating member within the integrally formed enclosure in sliding relationship with the latch, wherein the actuating member is configured to actuate the latch when the button is depressed, and when the lid is in the closed position, the latch engages the catch, such that when actuated, the latch disengages the catch.

11. The container of claim 1, wherein at least two spring members extend away from the button in sliding relationship with the base.

12. The container of claim 7, wherein the arched leg has an arched shaped before the button is pressed.

13. The container of claim 7, further comprising a second arched leg extending away from the button into sliding relationship with the track within the integrally formed enclosure.

14. The container of claim 13, wherein each arched leg comprises at least two leg portions.

* * * * *